US011085629B2

(12) United States Patent
Grosser et al.

(10) Patent No.: US 11,085,629 B2
(45) Date of Patent: Aug. 10, 2021

(54) DEVICE FOR DISSIPATING HEAT FROM A HEAT SOURCE, AND USE THEREOF

(71) Applicant: Covestro Deutschland AG, Leverkusen (DE)

(72) Inventors: Ulrich Grosser, Kürten (DE); Matthias Knaupp, Langenfeld (DE); Thomas Grimm, Cologne (DE)

(73) Assignee: COVESTRO DEUTSCHLAND AG, Leverkusen (DE)

( * ) Notice: Subject to any disclaimer, the term of this patent is extended or adjusted under 35 U.S.C. 154(b) by 0 days.

(21) Appl. No.: 16/769,806

(22) PCT Filed: Dec. 12, 2018

(86) PCT No.: PCT/EP2018/084473

§ 371 (c)(1),
(2) Date: Jun. 4, 2020

(87) PCT Pub. No.: WO2019/121197

PCT Pub. Date: Jun. 27, 2019

(65) Prior Publication Data

US 2021/0172593 A1 Jun. 10, 2021

(30) Foreign Application Priority Data

Dec. 18, 2017 (EP) ..... 17207887

(51) Int. Cl.
*F21V 29/78* (2015.01)
*F21S 45/48* (2018.01)
(Continued)

(52) U.S. Cl.
CPC ..... *F21V 29/78* (2015.01); *F21S 45/48* (2018.01); *F21V 29/51* (2015.01); *F21V 29/87* (2015.01);
(Continued)

(58) Field of Classification Search
CPC ..... F21V 29/78; F21V 29/51; F21V 29/87; F21S 45/48; F28D 15/02
See application file for complete search history.

(56) References Cited

U.S. PATENT DOCUMENTS 6,408,935 B1 6/2002 DeHoff et al.
7,124,806 B1 10/2006 Wang et al.
(Continued)

FOREIGN PATENT DOCUMENTS

CN 104968179 10/2015
DE 102007055165 A1 5/2009
(Continued)

OTHER PUBLICATIONS

International Search Report for International Patent Application No. PCT/EP2018/084473, dated Feb. 11, 2019.
(Continued)

*Primary Examiner* — Anne M Hines
(74) *Attorney, Agent, or Firm* — K&L Gates LLP

(57) ABSTRACT

A heat dissipation system for a heat source, wherein the heat dissipation system comprises a heat pipe, a heat coupling-in element, and a heat coupling-out element, wherein the heat coupling-out element comprises at least 50% by weight of a thermally conductive thermoplastic composition having an in-plane thermal conductivity of 1 to 50 W/(m*K). Also provided is a luminaire.

9 Claims, 1 Drawing Sheet

(51) Int. Cl.

| | |
|---|---|
| ***F21V 29/51*** | (2015.01) |
| ***F28D 15/02*** | (2006.01) |
| ***F21V 29/87*** | (2015.01) |
| *F21Y 115/10* | (2016.01) |
| *F21K 9/00* | (2016.01) |

(52) U.S. Cl.
CPC ..... *F28D 15/02* (2013.01); *F21K 9/00* (2013.01); *F21Y 2115/10* (2016.08)

(56) References Cited

U.S. PATENT DOCUMENTS

2014/0340913 A1* 11/2014 Cui ..... F21K 9/238 362/382
2017/0205063 A1 7/2017 Kadijk et al.

FOREIGN PATENT DOCUMENTS

EP 3240099 A1 11/2017
WO 9926286 A1 5/1999

OTHER PUBLICATIONS

Written Opinion for International Patent Application No. PCT/EP2018/084473, dated Feb. 11, 2019.

* cited by examiner

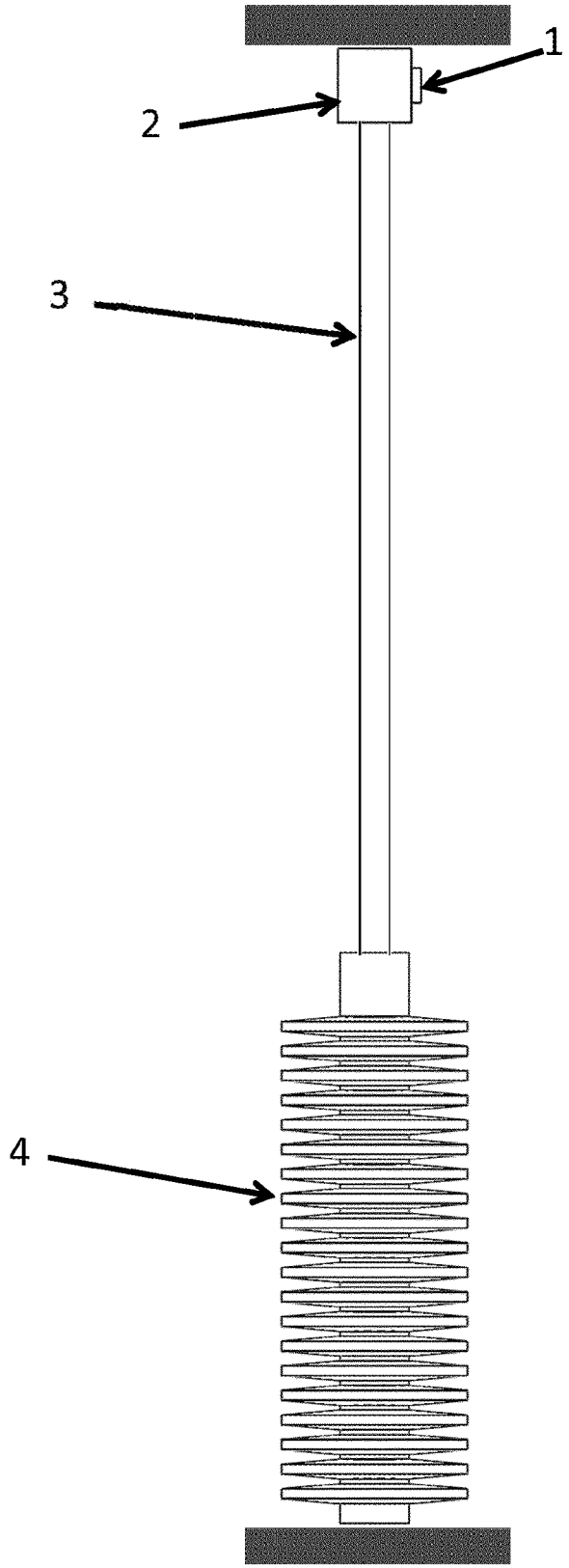
1
2
3
4

DEVICE FOR DISSIPATING HEAT FROM A HEAT SOURCE, AND USE THEREOF

CROSS REFERENCE TO RELATED APPLICATIONS

This application is a U.S. national stage application, filed under 35 U.S.C. § 371, of International Application No. PCT/EP2018/084473, which was filed on Dec. 12, 2018, and which claims priority to European Patent Application No. 17207887.5, which was filed on Dec. 18, 2017. The contents of each are incorporated by reference into this specification.

FIELD

The present invention provides an apparatus for dissipating heat from a heat source. This apparatus comprises a heat pipe, a heat coupling-in element and a heat coupling-out element, also called a heatsink, wherein the heatsink substantially consists of a thermally conductive thermoplastic composition having an in-plane thermal conductivity of 1 to 50 W/(m*K), preferably 2 to 30 W/(m*K), preferably 4 to 20 W/(m*K). The ratio of external diameter to wall thickness of the heat pipe is preferably from 10:1 to 4:1 here. The present invention also provides a luminaire comprising the apparatus according to the invention.

BACKGROUND

Energy losses occur in all conversions of one form of energy into another. This energy loss generally becomes noticeable through the emission of heat. This results in mechanical, electrical and electronic and other apparatuses, devices and instruments, hereafter referred to collectively as apparatuses, heating up during operation. This heating can in turn lead to the apparatuses or parts of these apparatuses or parts of the surroundings of these apparatuses being damaged, which is of course undesirable.

In order to avoid such damage or at least to reduce it, devices with which the excess heat can be dissipated from a heat source have already been provided early in the history of the technology. In the simplest case, this can be done by means of cooling via flowing water or an air flow, water or air thus serving as heat conducting medium. In particular in the latter case, the cooling is frequently assisted by what is known as a heatsink, which has good thermal conductivity and is usually designed so that it has a large surface area via which the heat can be dissipated.

Obviously, the more constricted the spatial conditions in the apparatus, the more difficult it is to dissipate heat from an apparatus or from the heat source of an apparatus. This applies in particular when the spatial conditions in the immediate vicinity of the heat source are very constricted and/or a heat-sensitive material is situated in the vicinity of the heat source. This difficulty is of ever growing prominence with the increasing miniaturization of apparatuses on the one hand and with the increasing use of plastics, in particular with the increasing use of thermoplastics, on the other.

One solution for overcoming this difficulty is the use of a heat pipe. These are known in principle to those skilled in the art.

A heat pipe is a heat transfer means which by way of utilizing the heat of evaporation of a working medium enables a high heat flux density, that is to say large amounts of heat can be transported on a small cross-sectional area. Although heat pipes can be used only in a limited temperature range, for example in the range from 0 to 250° C. for heat pipes made of copper and using water as the working medium, within this range they have a thermal resistance which is markedly lower than that of metals. The behavior of the heat pipes is thus very similar to the isothermal change of state. An almost constant temperature prevails over the length of the heat pipe. For the same transfer capacity considerably more lightweight designs are therefore possible than with conventional heat transfer means under the same conditions of use. Heat pipes comprise a hermetically encapsulated volume in the form of a pipe, with in each case one end facing the heat source and one end facing the heatsink. The pipe is filled with a working medium, for example water or ammonia, of which a small portion fills the volume in the liquid state and a relatively large portion fills the volume in the vaporous state. When heat is introduced, the working medium begins to evaporate, specifically at the end facing the heat source. As a result, in the vapor space the pressure is increased locally above the liquid surface, which leads to a slight pressure gradient within the heat pipe. The vapor generated thus flows to a location with a lower temperature, that is to say to the end facing the heatsink, where it condenses. The temperature rises at this location as a result of the heat of condensation released. The previously absorbed latent heat is released to the surroundings. The now liquid working medium returns via capillary forces back to the location at which the heat is introduced. (Source: Wikipedia.)

Since heat pipes can be designed to be very thin, they are well suited with these properties to dissipating the heat of a heat source away from the latter in spatially constricted conditions. For instance, US20040252502A1 discloses an LED reflector in which the waste heat of the LEDs is dissipated by way of a heat pipe. The reflector contains a thermally conductive plastic and in this case simultaneously serves as a heat coupling-in element, with the heat pipe being insert molded with the thermally conductive plastic in order to ensure improved heat transfer from the reflector to the heat pipe. The device disclosed in US20040252502A1 is used for example in vehicle front headlamps, vehicle rear lights, turn signals or other illumination apparatuses comprising LEDs.

However, it has been found that the insert molding of heat pipes with plastic is difficult, since under the pressures arising during the insert molding the heat pipes frequently collapse, burst or are otherwise damaged at least to such an extent that an effective dissipation of heat is hindered, for example by denting of the heat pipe in places, resulting in damage to the internal structure of the heat pipe at this location. Since such damage is generally located within the insert-molded region of the heat pipe, it is not easily visible on account of the insert molding. This may result in an insert-molded heat pipe that has been damaged in this way being processed further and the damage only being noticed during a later quality control or even only when an overall apparatus having the heat pipe fails. However, at this point in time repairing the damage is complex and expensive. This problem has been found both in the very frequently used heat pipes with a copper casing and also for example in heat pipes with a stainless steel casing.

It has also been found that the use of thermally conductive plastic as a component of a heat coupling-in element is not very effective, since, on account of the substantially lower in-plane thermal conductivity of thermally conductive plastics (1 to 50 W/(m*K)) compared to the thermal conductivity of metals such as copper (240 to 401 W/(m*K), depending on purity) or else aluminum (75 to 236 W/(m*K), depending on purity), an effective transfer of the heat emitted by the heat source to the heat pipe cannot be ensured. In this case, it is also of little help to increase the surface area of the heat coupling-in element containing a thermally conductive plastic. Although this does result in better absorption of the heat emitted by the heat source, this does not necessarily lead to this heat also being quantitatively supplied to the heat pipe. In contrast, an increased surface area of the heat coupling-in element results in more heat being emitted to the surroundings of the heat source, therefore this heat does not reach the heat transfer surface of the end of the heat pipe which faces the heat source and hence effective dissipation of the heat via the heat pipe cannot take place either. This can in turn lead to problems by way of example in a vehicle front headlamp in which for example due to LEDs as the lighting means there is a heat source which locally emits waste heat at a high temperature which must be dissipated. For instance, electrical components or heat-sensitive materials of the lamp in the proximity of an LED or the LED itself may for example be damaged. Of course, such problems also arise in other lighting means, for example halogen lamps.

In addition, US20040252502A1 does not disclose how the heat removed from the heat source can be utilized.

SUMMARY

It is therefore an object of the present invention to provide an apparatus which overcomes the disadvantages of the prior art.

Therefore, it is in particular an object of the present invention to provide an apparatus comprising a heat pipe for the dissipation of heat from a heat source which reliably and effectively dissipates the waste heat from this heat source.

The heat pipe is intended to be suitable for being insert molded with a plastic without collapsing, bursting or else just being damaged to the extent that an effective dissipation of heat is hindered. For example, the capacity of the heat pipe to dissipate heat after the insert molding should be at least 80%, preferably at least 90%, particularly preferably at least 95%, especially at least 98%, of the capacity to dissipate heat of the non-insert-molded heat pipe, that is to say the heat pipe prior to the insert molding.

The apparatus should also have a heat coupling-in element that ensures an effective transfer of the heat emitted by the heat source to the heat pipe.

The apparatus should also have a heat coupling-in element which contains a thermally conductive plastic.

The apparatus should preferably also be suitable for using the heat dissipated from the heat source productively at another location.

The object is achieved by an apparatus which has a heat pipe, a heat coupling-in element, and a heat coupling-out element, wherein the heat coupling-out element consists to an extent of at least 50% by weight of a thermally conductive thermoplastic composition and wherein the heat pipe, in particular the end of the heat pipe which faces the heat coupling-out element, has been insert molded with the thermally conductive thermoplastic composition of the heat coupling-out element. The ratio of external diameter to wall thickness of the heat pipe is preferably from 10:1 to 4:1 here.

The heat coupling-out element by preference consists to an extent of at least 65% by weight, preferably to an extent of at least 80% by weight, particularly preferably to an extent of at least 95% by weight, of a thermally conductive thermoplastic composition.

A functional element may additionally be attached to the heatsink, for example a fastening element or a housing. This functional element may likewise be a thermoplastic composition and may have been injection molded on. The thermoplastic composition of the functional element does not need to be a thermally conductive thermoplastic composition within the context of the present invention, but it can be. This functional element is also not considered to be a component of the heatsink within the context of the present invention This thermally conductive thermoplastic composition preferably has an in-plane thermal conductivity of 1 to 50 W/(m*K), preferably 2 to 30 W/(m*K), preferably 4 to 20 W/(m*K). When in-plane thermal conductivity is mentioned in connection with the present invention, this means the thermal conductivity determined according to ASTM E 1461-01 at 23° C. The ratio of external diameter to wall thickness of the heat pipe is by preference from 10:1 to 4:1, preferably from 8:1 to 4:1, particularly preferably 7:1 to 5:1.

The preferred working medium of the heat pipe is water, optionally water with additives.

In the range of the ratios reported, firstly it is prevented that the heat pipe collapses, bursts or is otherwise damaged during the insert molding with the thermally conductive thermoplastic composition of the heat coupling-out element, and secondly the capacity to effectively dissipate heat is not reduced. For example, the capacity of the heat pipe to dissipate heat after the insert molding is at least 80%, preferably at least 90%, particularly preferably at least 95%, especially at least 98%, of the capacity to dissipate heat of the heat pipe prior to the insert molding.

In a preferred embodiment of the invention, the heat dissipation system is designed as a component of a luminaire, preferably of a lamp, particularly preferably of a vehicle front headlamp or vehicle taillamp, collectively referred to hereafter as vehicle lamp.

In this case, the heat coupling-out element is preferably designed as part of the housing of a vehicle lamp, in particular of a vehicle front headlamp or vehicle taillamp. When using LEDs in these lamps, there is specifically the problem that the lenses of these lamps are hardly warmed by the waste heat of the LEDs. Although in operation LEDs locally generate waste heat at a high temperature which has to be effectively dissipated, as already described above, the total amount of heat energy emitted by an LED in comparison for example with halogen lighting means for a given light yield is firstly substantially lower and secondly the heat formed is almost exclusively emitted at the rear side and not in the form of thermal radiation in the direction of the lens. If in cold weather lenses of the lamps fog up or freeze over, in conventional vehicle lamps the waste heat from the LEDs is not sufficient to free the lamp lenses of fogging or frost. This can lead to the amount of light emitted from such lamps no longer being sufficient for safe participation in road traffic.

According to the invention, the heat coupling-out element can be designed in this case as a heatsink which is located inside or outside, preferably inside, particularly preferably inside at the bottom, on the vehicle lamp lens and heats same, in particular by convection, but also by heat conduction and thermal radiation.

The heatsink is preferably designed as a body with a structured surface area in order to increase same. For instance, it can for example be designed as an essentially flat body, for example as a disk, or as a body with planar protrusions such as for example cooling fins;

other forms which have an increased surface area are however also possible according to the invention.

As an alternative according to the invention, the heatsink may also be designed as a cuboid, cylinder, sphere, cone or any other form that serves the purpose of the heatsink.

In this way it can be ensured that, even in the case of a vehicle lamp equipped with LEDs, especially in a vehicle lamp equipped only with LEDs, in cold weather the vehicle lamp lens is freed of fogging or frost after a short time when the light is switched on.

When mention is made here of an LED (light emitting diode; plural LEDs), this means a light-emitting semiconductor component the electrical properties of which correspond to a diode, and also laser diodes, that is to say semiconductor components which generate laser radiation.

The present invention therefore provides:

A heat dissipation system for a heat source, wherein the heat dissipation system has a heat pipe, a heat coupling-in element, a heat coupling-out element (heatsink), wherein the heat coupling-out element consists to an extent of at least 65% by weight, particularly preferably to an extent of at least 80% by weight, very particularly preferably to an extent of at least 95% by weight, of a thermally conductive thermoplastic composition having an in-plane thermal conductivity of 1 to 50 W/(m*K), preferably 2 to 30 W/(m*K), preferably 4 to 20 W/(m*K). The ratio of external diameter to wall thickness of the heat pipe is preferably from 10:1 to 4:1 here.

The ratio of external diameter to wall thickness of the heat pipe is preferably from 8:1 to 4:1, particularly preferably 7:1 to 5:1.

The heat pipe of the heat dissipation system is preferably insert molded with the thermally conductive thermoplastic composition of the heat coupling-out element.

The capacity of the heat pipe to dissipate heat after the insert molding by preference is at least 80%, preferably at least 90%, particularly preferably at least 95%, especially at least 98%, of the capacity to dissipate heat of the non-insert-molded heat pipe.

The thermally conductive thermoplastic composition is preferably a composition containing a polycarbonate.

The heat source by preference is a lighting means, preferably an LED.

The heat dissipation system is preferably a component of a luminaire, particularly preferably of a lamp, very particularly preferably of a vehicle lamp, especially particularly preferably of a vehicle front headlamp or vehicle taillamp.

It is preferably a component of the housing of a vehicle lamp.

As an alternative, the heat coupling-out element is preferably designed as a heatsink which is located inside on the vehicle lamp lens and heats same.

The present invention also provides:

A luminaire comprising the heat dissipation system according to the invention.

This luminaire is preferably a lamp, particularly preferably a vehicle lamp.

BRIEF DESCRIPTION OF THE DRAWINGS

A preferred configuration of the invention is illustrated by the following FIGURE, without the invention being restricted thereby to this configuration.

FIG. 1 here shows the heat dissipation system according to the invention for a heat source

DETAILED DESCRIPTION

The thermally conductive thermoplastic composition can by way of example be selected from those described in WO 2015/135958 A1. These compositions contain:

A) 20.0% to 80.49% by weight of polycarbonate,

B) 15.0% to 60.0% by weight of expanded graphite, the D(0.5) of the graphite determined by sieve analysis in accordance with DIN 51938 being <1.2 mm, C) 4.5% to 10% by weight of at least one phosphorus compound of the general formula (V)

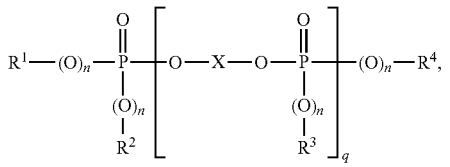

(V)

in which $R^1$, $R^2$, $R^3$ and $R^4$ independently of one another are $C_1$- to $C_8$-alkyl, in each case optionally halogenated and in each case branched or unbranched, and/or $C_5$- to $C_6$-cycloalkyl, $C_6$- to $C_{20}$-aryl or $C_7$- to $C_{12}$-aralkyl, in each case optionally substituted by branched or unbranched alkyl, preferably $C_1$- to $C_4$-alkyl, and/or halogen, preferably chlorine and/or bromine, n is independently 0 or 1, q is an integer from 0 to 30, X is a mono- or polycyclic aromatic radical having 6 to 30 carbon atoms or a linear or branched aliphatic radical having 2 to 30 carbon atoms, each of which may be substituted or unsubstituted, and bridged or unbridged;

D) 0.01% to 5.0% by weight of at least one ethylene/alkyl (meth)acrylate copolymer which preferably has a melt flow index of at least 2.5 g/10 min, determined according to ASTM D1238 (at 190° C. and 2.16 kg), E) optionally at least one further polymer additive selected from the group of thermal stabilizers, flame retardants other than component C, antistats, colorants, pigments, mold release agents, UV absorbers, IR absorbers, and/or of fillers selected from the group of chalk, quartz powder, titanium dioxide, silicates, aluminosilicates, aluminum oxide, silica, magnesium hydroxide and/or aluminum hydroxide, wherein the components A to E add up to 100% by weight.

The thermoplastic compositions according to the invention have a minimum (in-plane) thermal conductivity of preferably ≥9 W/(m*K), a heat distortion resistance of ≥100° C. and also a melt volume-flow rate at 330° C. and 2.16 kg load of ≥10 $cm^3$/10 min. Particularly preferred thermoplastic compositions according to the invention have a heat distortion resistance ≥110°.

Thermoplastic compositions according to the invention moreover feature a longitudinal shrinkage of ≤0.14% and a modulus of elasticity of ≤6500 $N/mm^2$, as a result of which the thermoplastic compositions have a sufficient resistance against an elastic deformation supplied from the outside, without displaying excessively rigid behavior.

Component A

Polycarbonates are used as component A.

"Polycarbonate" is understood according to the invention to mean both homopolycarbonates and copolycarbonates and also polyester carbonates.

The thermoplastic polycarbonates including the thermoplastic aromatic polyester carbonates have average molecular weights $M_w$ (determined by measuring the relative viscosity at 25° C. in $CH_2Cl_2$ and at a concentration of 0.5 g per 100 ml of $CH_2Cl_2$) of 20 000 g/mol to 32 000 g/mol, preferably of 23 000 g/mol to 31 000 g/mol, in particular of 24 000 g/mol to 31 000 g/mol.

A portion of up to 80 mol %, preferably of 20 mol % to 50 mol %, of the carbonate groups in the polycarbonates used according to the invention may be replaced by aromatic dicarboxylic ester groups. Polycarbonates of this type that incorporate not only acid radicals derived from carbonic acid but also acid radicals derived from aromatic dicarboxylic acids in the molecular chain are referred to as aromatic polyester carbonates. In the context of the present invention, they are covered by the umbrella term of thermoplastic aromatic polycarbonates.

The polycarbonates are prepared in a known manner from diphenols, carbonic acid derivatives, optionally chain terminators and optionally branching agents, and the polyester carbonates are prepared by replacing a portion of the carbonic acid derivatives with aromatic dicarboxylic acids or derivatives of the dicarboxylic acids, specifically with aromatic dicarboxylic ester structural units according to the carbonate structural units that are to be replaced in the aromatic polycarbonates.

Dihydroxyaryl compounds suitable for the preparation of polycarbonates are those of the formula (2)

$$HO—Z—OH \quad (2),$$

in which

Z is an aromatic radical which has 6 to 30 carbon atoms and may contain one or more aromatic rings, may be substituted and may contain aliphatic or cycloaliphatic radicals or alkylaryls or heteroatoms as bridging elements.

It is preferable for Z in formula (2) to be a radical of the formula (3)

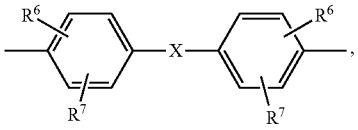

(3)

in which $R^6$ and $R^7$ independently of one another are H, $C_1$- to $C_{18}$-alkyl, $C_1$- to $C_{18}$-alkoxy, halogen such as Cl or Br or in each case optionally substituted aryl- or aralkyl, preferably H or $C_1$- to $C_{12}$-alkyl, particularly preferably H or $C_1$- to $C_8$-alkyl and very particularly preferably H or methyl, and X is a single bond, —$SO_2$—, —CO—, —O—, —S—, $C_1$- to $C_6$-alkylene, $C_2$- to $C_5$-alkylidene or $C_5$- to $C_6$-cycloalkylidene which may be substituted by $C_1$- to $C_6$-alkyl, preferably methyl or ethyl, or else $C_6$- to $C_{12}$-arylene which may optionally be fused to further aromatic rings containing heteroatoms.

Preferably, X is a single bond, $C_1$- to $C_5$-alkylene, $C_2$- to $C_5$-alkylidene, $C_5$- to $C_6$-cycloalkyl idene, —O—, —SO—, —CO—, —S—, —$SO_2$— or a radical of the formula (3a) or (3b)

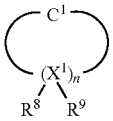

(3a)

-continued

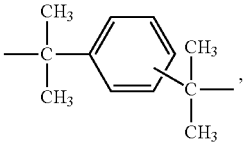

(3b)

where $R^8$ and $R^9$ can be chosen individually for each $X^1$, and independently of one another are hydrogen or $C_1$ to $C_6$-alkyl, preferably hydrogen, methyl or ethyl, and $X^1$ is carbon and n is an integer from 4 to 7, preferably 4 or 5, with the proviso that, on at least one $X^1$ atom, $R^8$ and $R^9$ are both alkyl.

Examples of dihydroxyaryl compounds (diphenols) are: dihydroxybenzenes, dihydroxydiphenyls, bis(hydroxyphenyl)alkanes, bis(hydroxyphenyl)cycloalkanes, bis(hydroxyphenyl)aryls, bis(hydroxyphenyl) ethers, bis(hydroxyphenyl) ketones, bis(hydroxyphenyl) sulfides, bis(hydroxyphenyl) sulfones, bis(hydroxyphenyl) sulfoxides, 1,1'-bis(hydroxyphenyl)diisopropylbenzenes and the ring-alkylated and ring-halogenated compounds thereof.

Diphenols suitable for preparing the polycarbonates to be used according to the invention are for example hydroquinone, resorcinol, dihydroxydiphenyl, bis(hydroxyphenyl)alkanes, bis(hydroxyphenyl)cycloalkanes, bis(hydroxyphenyl) sulfides, bis(hydroxyphenyl) ethers, bis(hydroxyphenyl) ketones, bis(hydroxyphenyl) sulfones, bis(hydroxyphenyl) sulfoxides, α,α'-bis(hydroxyphenyl) diisopropylbenzenes and alkylated, ring-alkylated and ring-halogenated compounds thereof.

Preferred diphenols are 4,4'-dihydroxydiphenyl, 2,2-bis(4-hydroxyphenyl)-1-phenylpropane, 1,1-bis(4-hydroxyphenyl)phenylethane, 2,2-bis(4-hydroxyphenyl)propane, 2,4-bis(4-hydroxyphenyl)-2-methylbutane, 1,3-bis[2-(4-hydroxyphenyl)-2-propyl]benzene (bisphenol M), 2,2-bis(3-methyl-4-hydroxyphenyl)propane, bis(3,5-dimethyl-4-hydroxyphenyl)methane, 2,2-bis(3,5-dimethyl-4-hydroxyphenyl)propane, bis(3,5-dimethyl-4-hydroxyphenyl) sulfone, 2,4-bis(3,5-dimethyl-4-hydroxyphenyl)-2-methylbutane, 1,3-bis[2-(3,5-dimethyl-4-hydroxyphenyl)-2-propyl]benzene and 1,1-bis(4-hydroxyphenyl)-3,3,5-trimethylcyclohexane (bisphenol TMC).

Particularly preferred diphenols are 4,4'-dihydroxydiphenyl, 1,1-bis(4-hydroxyphenyl)phenylethane, 2,2-bis(4-hydroxyphenyl)propane, 2,2-bis(3,5-dimethyl-4-hydroxyphenyl)propane, 1,1-bis(4-hydroxyphenyl)cyclohexane and 1,1-bis(4-hydroxyphenyl)-3,3,5-trimethylcyclohexane (bisphenol TMC).

These and other suitable diphenols are described by way of example in U.S. Pat. No. 2,999,835 A, 3 148 172 A, 2 991 273 A, 3 271 367 A, 4 982 014 A and 2 999 846 A, in German laid-open specifications 1 570 703 A, 2 063 050 A, 2 036 052 A, 2 211 956 A and 3 832 396 A, in the French patent specification 1 561 518 A1, in the monograph "H. Schnell, Chemistry and Physics of Polycarbonates, Interscience Publishers, New York 1964, p. 28 ff.; p. 102 ff.", and in "D. G. Legrand, J. T. Bendler, Handbook of Polycarbonate Science and Technology, Marcel Dekker New York 2000, p. 72 ff.".

In the case of the homopolycarbonates only one diphenol is used and in the case of copolycarbonates two or more diphenols are used. The diphenols used, like all the other chemicals and auxiliaries added to the synthesis, may be contaminated with the impurities originating from their own synthesis, handling and storage. However, it is desirable to work with the purest possible raw materials.

The monofunctional chain terminators required for molecular-weight regulation, for example phenols or alkylphenols, in particular phenol, p-tert-butylphenol, isooctylphenol, cumylphenol, chlorocarbonic esters thereof or acyl chlorides of monocarboxylic acids or mixtures of these chain terminators, are either supplied to the reaction with the bisphenoxide(s) or else are added at any desired juncture in the synthesis provided that phosgene or chlorocarbonic acid end groups are still present in the reaction mixture or, in the case of acyl chlorides and chlorocarbonic esters as chain terminators, as long as sufficient phenolic end groups of the forming polymer are available. However, it is preferable for the chain terminator(s) to be added after the phosgenation at a location or at a juncture at which phosgene is no longer present but the catalyst has not yet been metered in, or for them to be metered in before the catalyst or together or in parallel with the catalyst.

Any branching agents or branching agent mixtures to be used are added to the synthesis in the same manner, but typically before the chain terminators. Compounds typically used are trisphenols, quaterphenols or acyl chlorides of tri- or tetracarboxylic acids, or else mixtures of the polyphenols or of the acyl chlorides.

Examples of some of the compounds that can be used as branching agents and have three, or more than three, phenolic hydroxyl groups are phloroglucinol, 4,6-dimethyl-2,4,6-tri(4-hydroxyphenyl)hept-2-ene, 4,6-dimethyl-2,4,6-tri(4-hydroxyphenyl)heptane, 1,3,5-tris(4-hydroxyphenyl)benzene, 1,1,1-tri(4-hydroxyphenyl)ethane, tris(4-hydroxyphenyl)phenylmethane, 2,2-bis[4,4-bis(4-hydroxyphenyl)cyclohexyl]propane, 2,4-bis(4-hydroxyphenylisopropyl)phenol, tetra(4-hydroxyphenyl)methane.

Some of the other trifunctional compounds are 2,4-dihydroxybenzoic acid, trimesic acid, cyanuric chloride and 3,3-bis(3-methyl-4-hydroxyphenyl)-2-oxo-2,3-dihydroindole.

Preferred branching agents are 3,3-bis(3-methyl-4-hydroxyphenyl)-2-oxo-2,3-dihydroindole and 1,1,1-tri(4-hydroxyphenyl)ethane.

The amount of any branching agents to be used is 0.05 mol % to 2 mol %, in turn based on moles of diphenols used in each case.

The branching agents may either be initially charged with the diphenols and the chain terminators in the aqueous alkaline phase or added dissolved in an organic solvent before the phosgenation.

All of these measures for preparing the polycarbonates are familiar to those skilled in the art.

Aromatic dicarboxylic acids that are suitable for the preparation of the polyester carbonates are, for example, orthophthalic acid, terephthalic acid, isophthalic acid, tert-butylisophthalic acid, 3,3'-diphenyldicarboxylic acid, 4,4'-diphenyldicarboxylic acid, 4,4-benzophenonedicarboxylic acid, 3,4'-benzophenonedicarboxylic acid, 4,4'-diphenyl ether dicarboxylic acid, 4,4'-diphenyl sulfone dicarboxylic acid, 2,2-bis(4-carboxyphenyl)propane, trimethyl-3-phenylindane-4,5'-dicarboxylic acid.

Among the aromatic dicarboxylic acids, particular preference is given to using terephthalic acid and/or isophthalic acid.

Derivatives of the dicarboxylic acids are the dicarbonyl halides and the dialkyl dicarboxylates, especially the dicarbonyl dichlorides and the dimethyl dicarboxylates.

The carbonate groups are replaced essentially stoichiometrically and also quantitatively by the aromatic dicarboxylic ester groups, and so the molar ratio of the coreactants is also reflected in the finished polyester carbonate. The aromatic dicarboxylic ester groups can be incorporated either randomly or in blocks.

Preferred modes of preparation of the polycarbonates to be used according to the invention, including the polyester carbonates, are the known interfacial process and the known melt transesterification process (cf. e.g. WO 2004/063249 A1, WO 2001/05866 A1, WO 2000/105867, U.S. Pat. Nos. 5,340,905 A, 5,097,002 A, 5,717,057 A).

In the former case, the acid derivatives used are preferably phosgene and optionally dicarbonyl dichlorides, and in the latter case preferably diphenyl carbonate and optionally dicarboxylic diesters. Catalysts, solvents, workup, reaction conditions etc. for polycarbonate preparation or polyester carbonate preparation are sufficiently well-described and known in both cases.

The polycarbonates, polyester carbonates and polyesters can be worked up in a known manner and processed into any desired shaped bodies, for example by extrusion or injection molding.

Component B

Expanded graphite is used as component B.

In the expanded graphites, the individual basal planes of the graphite have been driven apart by a special treatment which results in an increase in volume of the graphite, preferably by a factor of 200 to 400. The production of expanded graphites is described inter alia in documents U.S. Pat. Nos. 1,137,373 A, 1,191,383 A and 3,404,061 A.

Graphites are used in the compositions in the form of fibers, rods, spheres, hollow spheres, platelets, in powder form, in each case either in aggregated or agglomerated form, preferably in platelet form.

In the present invention, the structure in platelet form is understood to mean a particle having a flat geometry. Thus, the height of the particles is typically distinctly smaller compared to the breadth or length of the particles. Such two-dimensional particles may in turn be agglomerated or aggregated into structures.

The height of the primary particles in platelet form is less than 500 nm, preferably less than 200 nm and particularly preferably less than 100 nm. As a result of the small sizes of these primary particles, the shape of the particles may be bent, curved, waved or deformed in some other way.

The length dimensions of the particles can be determined by standard methods, for example electron microscopy.

Graphite is used in the thermoplastic compositions according to the invention in amounts of 15.0% to 60.0% by weight, preferably 20.0% to 45.0% by weight, particularly preferably 20.0% to 35.0% by weight, very particularly preferably 30.0% to 35% by weight, in order to obtain a good thermal conductivity of the thermoplastic compositions and at the same time ensure a high processing latitude.

Preference is given according to the invention to using a graphite having a relatively high specific surface area, determined as the BET surface area by means of nitrogen adsorption according to ASTM D3037. Preference is given to using graphites having a BET surface area of $\geq 5\ m^2/g$, particularly preferably $\geq 10\ m^2/g$ and very particularly preferably $\geq 18\ m^2/g$ in the thermoplastic compositions.

The D(0.5) of the graphite, determined by sieve analysis in accordance with DIN 51938, is <1.2 mm.

Preferably, the graphites have a particle size distribution characterized by the D(0.9) of at least 1 mm, preferably of at least 1.2 mm, more preferably of at least 1.4 mm and yet more preferably of at least 1.5 mm.

Likewise preferably, the graphites have a particle size distribution characterized by the D(0.5) of at least 400 μm, preferably of at least 600 μm, more preferably of at least 750 μm and yet more preferably of at least 850 μm.

The graphites preferably have a particle size distribution characterized by the D(0.1) of at least 100 μm, preferably of at least 150 μm, more preferably of at least 200 μm and yet more preferably of at least 250 μm.

The parameters D(0.1), D(0.5) and D(0.9) are determined by sieve analysis in accordance with DIN 51938.

The graphites used have a density, determined with xylene, in the range from 2.0 g/cm$^3$ to 2.4 g/cm$^3$, preferably from 2.1 g/cm$^3$ to 2.3 g/cm$^3$ and more preferably from 2.2 g/cm$^3$ to 2.27 g/cm$^3$.

The carbon content of the graphites used according to the invention, determined according to DIN 51903 at 800° C. for 20 hours, is preferably ≥90%, more preferably ≥95% and yet more preferably ≥98%.

The residual moisture content of the graphites used according to the invention, determined according to DIN 38414 at 110° C. for 8 hours, is preferably ≤5%, more preferably ≤3% and yet more preferably ≤2%.

The thermal conductivity of the graphites used according to the invention, prior to processing, is between 250 and 400 W/(m*K) parallel to the basal planes and between 6 and 8 W/(m*K) perpendicular to the basal planes.

The electrical resistivity of the graphites used according to the invention, prior to processing, is about 0.001 Ω*cm parallel to the basal planes and less than 0.1 Ω*cm perpendicular to the basal planes.

The bulk density of the graphites, determined to DIN 51705, is typically between 50 g/l and 250 g/l, preferably between 65 g/l and 220 g/l and more preferably between 100 g/l and 200 g/l.

Preference is given to using graphites having a sulfur content of less than 200 ppm in the thermoplastic compositions.

Preference is additionally given to using graphites having a leachable chlorine ion content of less than 100 ppm in the thermoplastic compositions.

Preference is likewise given to using graphites having a content of nitrates and nitrites of less than 50 ppm in the thermoplastic compositions.

Particular preference is given to using graphites having all of these limiting values, i.e. for the sulfur, chlorine ion, nitrate and nitrite content.

Commercially available graphites are inter alia Ecophit® GFG 5, Ecophit® GFG 50, Ecophit® GFG 200, Ecophit® GFG 350, Ecophit® GFG 500, Ecophit® GFG 900, Ecophit®GFG 1200 from SGL Carbon GmbH, TIMREX® BNB90, TIMREX® KS5-44, TIMREX® KS6, TIMREX® KS150, TIMREX® SFG44, TIMREX® SFG150, TIMREX® C-THERM™ 001 and TIMREX® C-THERM™ 011 from TIMCAL Ltd., SC 20 O, SC 4000 O/SM and SC 8000 O/SM from Graphit Kropfmühl AG, Mechano-Cond 1, Mechano-Lube 2 and Mechano-Lube 4G from H.C. Carbon GmbH, Nord-Min 251 and Nord-Min 560T from Nordmann Rassmann GmbH and ASBURY A99, Asbury 230U and Asbury 3806 from Asbury Carbons.

Component C

Components C in the context of the invention are selected from the group of the mono- and oligomeric phosphoric and phosphonic esters, and it is also possible to use mixtures of a plurality of components selected from one group or various groups among these as component C.

Mono- and oligomeric phosphoric and phosphonic esters used according to the invention are phosphorus compounds of the general formula (V)

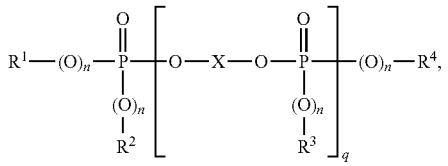

(V)

in which $R^1$, $R^2$, $R^3$ and $R^4$ independently of one another are $C_1$- to $C_8$-alkyl, in each case optionally halogenated and in each case branched or unbranched, and/or $C_5$- to $C_6$-cycloalkyl, $C_6$- to $C_{20}$-aryl or $C_7$- to $C_{12}$-aralkyl, in each case optionally substituted by branched or unbranched alkyl, and/or halogen, preferably chlorine and/or bromine, n is independently 0 or 1, q is an integer from 0 to 30 and X is a mono- or polycyclic aromatic radical having 6 to 30 carbon atoms or a linear or branched aliphatic radical having 2 to 30 carbon atoms, each of which may be substituted or unsubstituted, and bridged or unbridged.

Preferably, $R^1$, $R^2$, $R^3$ and $R^4$ independently of one another are branched or unbranched $C_1$- to $C_4$-alkyl, phenyl, naphthyl or $C_1$- to $C_4$-alkyl-substituted phenyl. In the case of aromatic R', $R^2$, $R^3$ and/or $R^4$ groups, these may in turn be substituted by halogen and/or alkyl groups, preferably chlorine, bromine and/or $C_1$- to $C_4$-alkyl, branched or unbranched. Particularly preferred aryl radicals are cresyl, phenyl, xylenyl, propylphenyl or butylphenyl, and also the corresponding brominated and chlorinated derivatives thereof.

X in formula (V) is preferably derived from diphenols.

n in formula (V) is preferably 1.

q is preferably 0 to 20, particularly preferably 0 to 10, and in the case of mixtures represents average values of 0.8 to 5.0, preferably 1.0 to 3.0, more preferably 1.05 to 2.00, and especially preferably of 1.08 to 1.60.

The phosphorus compound of general formula V is preferably a compound of the formula I:

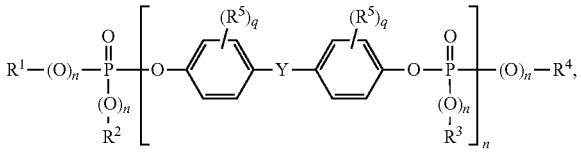

(I)

in which $R^1$, $R^2$, $R^3$ and $R^4$ independently of one another are linear or branched $C_1$- to $C_8$-alkyl and/or optionally linear or branched alkyl-substituted $C_5$- to $C_6$-cycloalkyl, $C_6$- to $C_{10}$-aryl or $C_7$- to $C_{12}$-aralkyl, n is independently 0 or 1, q is independently 0, 1, 2, 3 or 4, N is a number between 1 and 30, $R_5$ and $R_6$ independently of one another are linear or branched $C_1$- to $C_4$-alkyl, preferably methyl, and Y is linear or branched $C_1$- to $C_7$-alkylidene, linear or branched $C_1$- to $C_7$-alkylene, $C_5$- to $C_{12}$-cycloalkylene, $C_5$- to $C_{12}$-cycloalkylidene, —O—, —S—, —SO—, $SO_2$ or —CO—.

is present.

X in formula V is particularly preferably

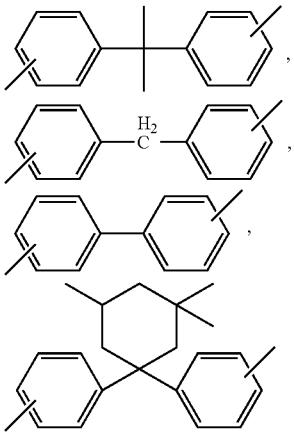

or the chlorinated and/or brominated derivatives thereof. X (together with the adjoining oxygen atoms) is preferably derived from hydroquinone, bisphenol A or diphenylphenol. It is likewise preferable for X to be derived from resorcinol. X is particularly preferably derived from bisphenol A.

Phosphorus compounds of the formula (V) are especially tributyl phosphate, triphenyl phosphate, tricresyl phosphate, diphenyl cresyl phosphate, diphenyl octyl phosphate, diphenyl 2-ethylcresyl phosphate, tri(isopropylphenyl) phosphate, resorcinol-bridged oligophosphate and bisphenol A-bridged oligophosphate. The use of oligomeric phosphoric esters of formula (V) which are derived from bisphenol A is especially preferred.

Component C is most preferably bisphenol A-based oligophosphate of formula (Va).

(Va)

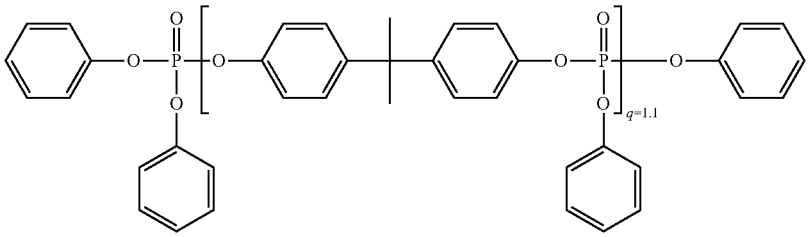

Particular preference is also given to oligophosphates analogous to formula (Va) in which q is between 1.0 and 1.2.

The phosphorus compounds according to component C are known (cf. for example EP 0 363 608 A1, EP 0 640 655 A2) or can be prepared in an analogous manner by known methods (e.g. Ullmanns Enzyklopädie der technischen Chemie [Ullmann's Encyclopaedia of Industrial Chemistry], Vol. 18, pp. 301 ff. 1979; Houben-Weyl, Methoden der organischen Chemie [Methods of Organic Chemistry], Vol. 12/1, p. 43; Beilstein Vol. 6, p. 177).

Preference is given to using mixtures of identical structure and different chain length, wherein the stated q value is the average q value. The average q value is determined by determining the composition of the phosphorus compound mixture (molecular weight distribution) by means of high pressure liquid chromatography (HPLC) at 40° C. in a mixture of acetonitrile and water (50:50) and using this to calculate the average values of q.

The compositions according to the invention contain 4.5% to 10% by weight, preferably 6.0% to 10.0% by weight, particularly preferably 6.0% to 9.0% by weight, of component C.

Alternatively particularly preferred compositions according to the invention contain 5.0% to 7.0% by weight of component C.

Component D

Component D within the context of the present invention is an ethylene/alkyl (meth)acrylate copolymer of the formula (VI)

(VI)

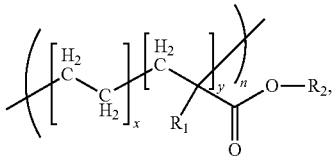

where $R_1$ is methyl or hydrogen, $R_2$ is hydrogen or a $C_1$- to $C_{12}$-alkyl radical, preferably methyl, ethyl, propyl, isopropyl, butyl, sec-butyl, tert-butyl, isobutyl, hexyl, isoamyl or tert-amyl, x and y are each an independent degree of polymerization (integer) and n is an integer ≥1.

The ratios of the degrees of polymerization x and y are preferably in the range from x:y=1:300 to 90:10.

The ethylene/alkyl (meth)acrylate copolymer can be a random, block or multiblock copolymer or mixtures of these structures. In one preferred embodiment, branched and unbranched ethylene/alkyl (meth)acrylate copolymers, particularly preferably linear ethylene/alkyl (meth)acrylate copolymers, are used.

The melt flow index (MFR) of the ethylene/alkyl (meth) acrylate copolymer (measured at 190° C. with 2.16 kg load, ASTM D1238) is preferably in the range from 2.5 40.0 g/(10 min), particularly preferably in the range from 3.0-10.0 g/(10 min), very particularly preferably in the range from 3.0-8.0 g/(10 min).

Preference is given to using Elvaloy 1820 AC (DuPont) in compositions according to the invention. This is an ethylene/methyl acrylate copolymer having a methyl acrylate content of 20% and a melt flow index of 8 g/(10 min), determined at 190° C. and 2.16 kg according to ASTM D1238.

The compositions according to the invention contain 0.01% to 5% by weight, preferably 2% to 4.5% by weight, very particularly preferably 3% to 4% by weight, of component D.

Component E

Additives which are customary for the thermoplastics mentioned, such as flame retardants other than component C, fillers, thermal stabilizers, antistats, colorants and pigments, mold release agents, UV absorbers and IR absorbers, can also be added to the polycarbonate compositions in the customary amounts.

The compositions according to the invention preferably do not contain any further flame retardants besides component C. The compositions according to the invention are preferably also free from fluorine-containing anti-dripping agents, such as from PTFE (polytetrafluoroethylene).

The amount of further additives is preferably up to 5% by weight, particularly preferably 0.01% to 3% by weight, based on the overall composition.

Suitable additives are for example described in "Additives for Plastics Handbook, John Murphy, Elsevier, Oxford 1999" and in "Plastics Additives Handbook, Hans Zweifel, Hanser, Munich 2001".

Suitable antioxidants/thermal stabilizers are for example alkylated monophenols, alkylthiomethylphenols, hydroquinones and alkylated hydroquinones, tocopherols, hydroxylated thiodiphenyl ethers, alkylidenebisphenols, O-, N- and S-benzyl compounds, hydroxybenzylated malonates, aromatic hydroxybenzyl compounds, triazine compounds, acylaminophenols, esters of β-(3,5-di-tert-butyl-4-hydroxyphenyl)propionic acid, esters of β-(5-tert-butyl-4-hydroxy-3-methylphenyl)propionic acid, esters of β-(3,5-dicyclohexyl-4-hydroxyphenyl)propionic acid, esters of 3,5-di-tert-butyl-4-hydroxyphenyl acetic acid, amides of β-(3,5-di-tert-butyl-4-hydroxyphenyl)propionic acid, suitable thio synergists, secondary antioxidants, phosphites and phosphonites, benzofuranones and indolinones.

Preference is given to organic phosphites such as triphenylphosphine, tritolylphosphine or 2,4,6-tri-t-butylphenyl 2-butyl-2-ethylpropane-1,3-diyl phosphite, phosphonates and phosphanes, usually those in which the organic radicals entirely or partially consist of optionally substituted aromatic radicals.

Very particularly suitable additives are IRGANOX® 1076 (octadecyl 3,5-di-tert-butyl-4-hydroxyhydrocinnamate, CAS No. 2082-79-3) and triphenylphosphine (TPP).

Suitable mold release agents are, for example, the esters or partial esters of mono- to hexahydric alcohols, especially of glycerol, of pentaerythritol or of Guerbet alcohols.

Monohydric alcohols are, for example, stearyl alcohol, palmityl alcohol and Guerbet alcohols. An example of a dihydric alcohol is glycol; an example of a trihydric alcohol is glycerol; examples of tetrahydric alcohols are pentaerythritol and mesoerythritol; examples of pentahydric alcohols are arabitol, ribitol and xylitol; examples of hexahydric alcohols are mannitol, glucitol (sorbitol) and dulcitol.

The esters are preferably the monoesters, diesters, triesters, tetraesters, pentaesters and hexaesters or mixtures thereof, especially statistical mixtures, of saturated aliphatic $C_{10}$ to $C_{36}$ monocarboxylic acids and optionally hydroxymonocarboxylic acids, preferably with saturated aliphatic $C_{14}$ to $C_{32}$ monocarboxylic acids and optionally hydroxymonocarboxylic acids.

The commercially available fatty acid esters, especially of pentaerythritol and of glycerol, may contain <60% different partial esters as a result of the preparation.

Examples of saturated aliphatic monocarboxylic acids having 10 to 36 carbon atoms are capric acid, lauric acid, myristic acid, palmitic acid, stearic acid, hydroxystearic acid, arachic acid, behenic acid, lignoceric acid, cerotic acid and montanic acids.

Suitable IR absorbers are disclosed, for example, in EP 1 559 743 A1, EP 1 865 027 A1, DE 10022037 A1, DE 10006208 A1 and in Italian patent applications RM2010A000225, RM2010A000227 and RM2010A000228. Of the IR absorbers mentioned in the literature cited, preference is given to those based on boride and tungstate, especially cesium tungstate or zinc-doped cesium tungstate, and also ITO- and ATO-based absorbers and combinations thereof.

Suitable UV absorbers from the class of the benzotriazoles are for example Tinuvin® 171 (2-[2-hydroxy-3-dodecyl-5-methylbenzyl)phenyl]-2H-benzotriazole (CAS No. 125304-04-3)), Tinuvin® 234 (2-[2-hydroxy-3,5-di(1,1-dimethylbenzyl)phenyl]-2H-benzotriazole (CAS No. 70321-86-7)), Tinuvin® 328 (2-[2-hydroxy-3,5-di-tert-amylphenyl]-2H-benzotriazole (CAS No. 25973-55-1)).

Suitable UV absorbers from the class of the oxalanilides are for example Sanduvor® 3206 (N-(2-ethoxyphenyl)ethanediamide (CAS No. 82493-14-9)) from Clariant or N-(2-ethoxyphenyl)-N'-(4-dodecylphenyl)oxamide (CAS No. 79102-63-9).

Suitable UV absorbers from the class of the hydroxybenzophenones are for example Chimasorb® 81 (2-benzoyl-5-octyloxyphenol (CAS No. 1843-05-6)) from BASF SE, 2,4-dihydroxybenzophenone (CAS No. 131-56-6), 2-hydroxy-4-(n-octyloxy)benzophenone (CAS No. 1843-05-6), 2-hydroxy-4-dodecyloxybenzophenone (CAS No. 2985-59-3).

Suitable UV absorbers from the class of the triazines are for example 2-[2-hydroxy-4-[3-(2-ethylhexyl-1-oxy)-2-hydroxypropyloxy]phenyl]-4,6-bis(2,4-dimethylphenyl)-1,3,5-triazine (CAS No. 137658-79-8), also known as Tinuvin® 405 (BASF SE), and 2,4-diphenyl-6-[2-hydroxy-4-(hexyloxy)phenyl]-1,3,5-triazine (CAS No. 147315-50-2), available as Tinuvin® 1577 (BASF SE).

The compound 2-[2-hydroxy-4-[(octyloxycarbonyl)ethylideneoxy]phenyl]-4,6-di(4-phenyl)phenyl-1,3,5-triazine has the CAS No. 204848-45-3 and is available from BASF SE under the name Tinuvin® 479.

The compound 2-[2-hydroxy-4-[(2-ethylhexyl)oxy]phenyl]-4,6-di(4-phenyl)phenyl-1,3,5-triazine has the CAS No. 204583-39-1 and is available from BASF SE under the name CGX-UVA006 or Tinuvin® 1600.

UV absorbers are generally used in an amount of 0.01% to 5% by weight, preferably 0.01% to 2% by weight, particularly preferably 0.01% to 0.05% by weight, based on the overall composition.

It is possible to add organic and inorganic fillers to the polycarbonate composition in customary amounts. Useful materials in principle for this purpose include all finely ground organic and inorganic materials. These may have for example a particulate, flaky or fibrous character. Examples of these include chalk, quartz powder, titanium dioxide, silicates/aluminosilicates, for example talc, wollastonite, mica/clay layered minerals, montmorillonite, especially also in an organophilic form modified by ion exchange, kaolin, zeolites, vermiculite, and also aluminum oxide, silica, magnesium hydroxide and aluminum hydroxide. It is also possible to use mixtures of different inorganic materials.

Preferred inorganic fillers are ultrafinely divided (nanoscale) inorganic compounds composed of one or more metals of main groups 1 to 5 and transition groups 1 to 8 of the Periodic Table, preferably from main groups 2 to 5, particularly preferably from main groups 3 to 5, or from transition groups 4 to 8, and comprising the elements oxygen, sulfur, boron, phosphorus, carbon, nitrogen, hydrogen and/or silicon.

Preferred compounds are, for example, oxides, hydroxides, water-containing/basic oxides, sulfates, sulfites, sulfides, carbonates, carbides, nitrates, nitrites, nitrides, borates, silicates, phosphates and hydrides.

Colorants or pigments used can be for example organic or inorganic pigments or organic dyes or the like.

Colorants or pigments in the context of the present invention are sulfur-containing pigments such as cadmium red or cadmium yellow, iron cyanide-based pigments such as Prussian blue, oxide pigments such as titanium dioxide, zinc oxide, red iron oxide, black iron oxide, chromium oxide, titanium yellow, zinc/iron-based brown, titanium/cobalt-based green, cobalt blue, copper/chromium-based black and copper/iron-based black or chromium-based pigments such as chromium yellow, phthalocyanine-derived dyes such as copper phthalocyanine blue or copper phthalocyanine green, fused polycyclic dyes and pigments such as azo-based (e.g. nickel azo yellow), sulfur indigo dyes, perinone-based, perylene-based, quinacridone-derived, dioxazine-based, isoindolinone-based and quinophthalone-derived derivatives, anthraquinone-based heterocyclic systems.

Specific examples of commercial products are, for example, MACROLEX® Blue RR, MACROLEX® Violet 3R, MACROLEX® Violet B (Lanxess AG, Germany), Sumiplast® Violet RR, Sumiplast® Violet B, Sumiplast® Blue OR, (Sumitomo Chemical Co., Ltd.), Diaresin® Violet D, Diaresin® Blue G, Diaresin® Blue N (Mitsubishi Chemical Corporation), Heliogen® Blue or Heliogen® Green (BASF AG, Germany).

Among these, preference is given to cyanine derivatives, quinoline derivatives, anthraquinone derivatives, phthalocyanine derivatives.

A preferred composition according to the invention contains

A) 20.0% to 77.0% by weight of polycarbonate,

B) 15.0% to 60.0% by weight of expanded graphite, the D(0.5) of the graphite determined by sieve analysis in accordance with DIN 51938 being <1.2 mm, C) 5.0% to 7.0% by weight of at least one phosphorus compound of the formula

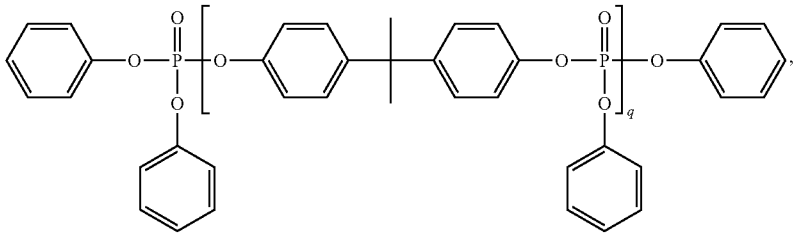

where q is between 1.0 and 1.2, preferably is 1.1,

D) 3.0% to 4.0% by weight of at least one ethylene/alkyl (meth)acrylate copolymer, E) optionally at least one further polymer additive selected from the group of thermal stabilizers, flame retardants other than component C, antistats, colorants, pigments, mold release agents, UV absorbers, IR absorbers, and/or of fillers selected from the group of chalk, quartz powder, titanium dioxide, silicates, aluminosilicates, aluminum oxide, silica, magnesium hydroxide and/or aluminum hydroxide, wherein the components A) to E) add up to 100% by weight.

In a particularly preferred embodiment, the composition according to the invention contains A) 52.0% to 72.0% by weight, preferably 52.0% to 71.0% by weight, of polycarbonate, B) 20.0% to 35.0% by weight of expanded graphite, the D(0.5) of the graphite determined by sieve analysis in accordance with DIN 51938 being <1.2 mm, C) 5.0% to 10.0%, preferably 5.0% to 7.0% by weight of at least one phosphorus compound of the formula

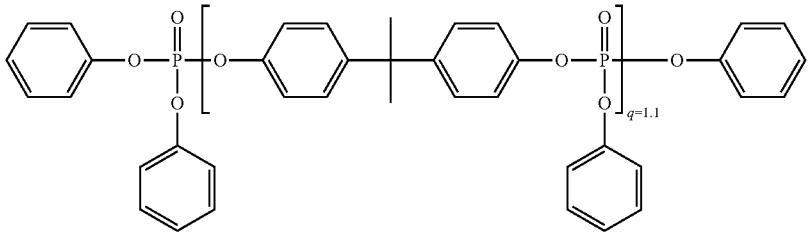

D) 2.0% to 4.0% by weight, preferably 3.0% to 4.0% by weight of at least one ethylene/alkyl (meth)acrylate copolymer, E) optionally at least one further polymer additive selected from the group of thermal stabilizers, flame retardants other than component (C), antistats, colorants, pigments, mold release agents, UV absorbers, IR absorbers, and/or of fillers selected from the group of chalk, quartz powder, titanium dioxide, silicates, aluminosilicates, aluminum oxide, silica, magnesium hydroxide and/or aluminum hydroxide, wherein the components A) to E) add up to 100% by weight.

In this embodiment, the melt flow index of component D is particularly preferably at least 2.5 g/10 min, determined according to ASTM D1238 (at 190° C. and 2.16 kg).

A further particularly preferred composition according to the invention contains A) 52.0% to 60.0% by weight of polycarbonate, B) 30.0% to 35.0% by weight of expanded graphite, the D(0.5) of the graphite determined by sieve analysis in accordance with DIN 51938 being <1.2 mm, C) 5.0% to 10.0% by weight, preferably 5.0% to 7.0% by weight of at least one phosphorus compound of the formula

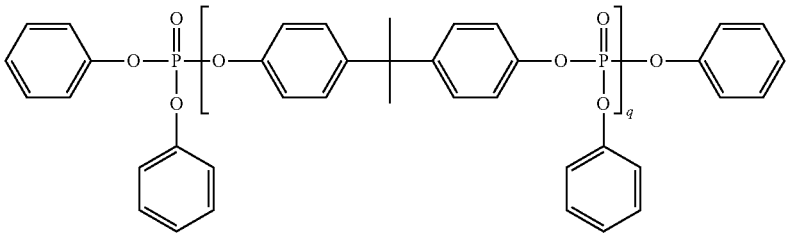

where q is between 1.0 and 1.2, preferably is 1.1,

D) 3.0% to 4.0% by weight of at least one ethylene/alkyl (meth)acrylate copolymer, E) optionally at least one further polymer additive selected from the group of thermal stabilizers, flame retardants other than component (C), antistats, colorants, pigments, mold release agents, UV absorbers, IR absorbers, and/or of fillers selected from the group of chalk, quartz powder, titanium dioxide, silicates, aluminosilicates, aluminum oxide, silica, magnesium hydroxide and/or aluminum hydroxide, wherein the components A) to E) add up to 100% by weight and wherein the composition is free from fluorine-containing anti-dripping agent.

The polymer compositions according to the invention which comprise the abovementioned components are produced by commonplace methods of incorporation, by combining, mixing and homogenizing the individual constituents, the homogenization in particular preferably taking place in the melt by application of shear forces. Combination and mixing is optionally effected prior to melt homogenization using powder pre-mixes.

It is also possible to use premixes of pellets or pellets and powders with the additives according to the invention.

It is also possible to use premixes produced from solutions of the mixture components in suitable solvents where homogenization is optionally effected in solution and the solvent is then removed.

In this case in particular, the components and aforementioned additives of the compositions according to the invention can be introduced by known processes or as a masterbatch.

The use of masterbatches is especially preferred for introduction of the additives, in which case masterbatches based on the respective polymer matrix in particular are used.

In this context, the composition can be combined, mixed, homogenized and then extruded in standard apparatuses such as screw extruders (for example twin-screw extruders (TSE)), kneaders or Brabender or Banbury mills. The extrudate can be cooled and comminuted after extrusion. It is also possible to premix individual components and then to add the remaining starting materials individually and/or likewise in a mixture.

Other thermally conductive thermoplastic compositions which are likewise usable for the present invention are disclosed for example in WO2012/174574A2, WO2017/005735A1, WO2017/005738A1 and WO2017005736A1, the thermally conductive thermoplastic compositions according to the invention and disclosed in WO2017/005735A1 being particularly suitable. In particular, the diglycerol esters disclosed in WO2017/005735A1 are particularly suitable as flow improvers in connection with the thermally conductive thermoplastic compositions according to the invention.

The diglycerol esters used as flow improvers are esters of carboxylic acids and diglycerol. Esters based on various carboxylic acids are suitable here. The esters may also be based on different isomers of diglycerol. It is possible to use not only monoesters but also polyesters of diglycerol. It is also possible to use mixtures rather than pure compounds.

Isomers of diglycerol which form the basis of the diglycerol esters used according to the invention are the following:

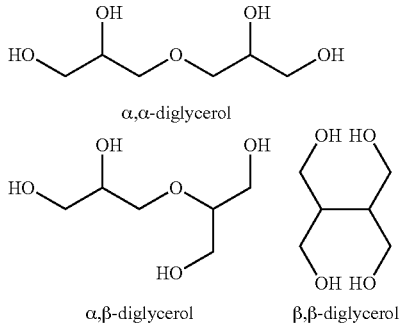

For the diglycerol esters used according to the invention, it is possible to use those isomers of these formulae that have been mono- or polyesterified. Mixtures usable as flow auxiliaries are composed of the diglycerol reactants and the ester end products derived therefrom, for example having molecular weights of 348 g/mol (monolauryl ester) or 530 g/mol (dilauryl ester).

The diglycerol esters present in the composition according to the invention preferably derive from saturated or unsaturated monocarboxylic acids having a chain length of from 6 to 30 carbon atoms. Examples of suitable monocarboxylic acids are caprylic acid ($C_7H_{15}COOH$, octanoic acid), capric acid ($C_9H_{19}COOH$, decanoic acid), lauric acid ($C_{11}H_{23}COOH$, dodecanoic acid), myristic acid ($C_{13}H_{27}COOH$, tetradecanoic acid), palmitic acid ($C_{15}H_{31}COOH$, hexadecanoic acid), margaric acid ($C_{16}H_{33}COOH$, heptadecanoic acid), stearic acid ($C_{17}H_{35}COOH$, octadecanoic acid), arachic acid ($C_{19}H_{39}COOH$, eicosanoic acid), behenic acid ($C_{21}H_{43}COOH$, docosanoic acid), lignoceric acid ($C_{23}H_{47}COOH$, tetracosanoic acid), palmitoleic acid ($C_{15}H_{29}COOH$, (9Z)-hexadeca-9-enoic acid), petroselinic acid ($C_{17}H_{33}COOH$, (6Z)-octadeca-6-enoic acid), elaidic acid ($C_{17}H_{33}COOH$, (9E)-octadeca-9-enoic acid), linoleic acid ($C_{17}H_{31}COOH$, (9Z,12Z)-octadeca-9,12-dienoic acid), alpha- or gamma-linolenic acid ($C_{17}H_{29}COOH$, (9Z,12Z,15Z)-octadeca-9,12,15-trienoic acid and (6Z,9Z,12Z)-octadeca-6,9,12-trienoic acid), arachidonic acid ($C_{19}H_{31}COOH$, (5Z,8Z,11Z,14Z)-eicosa-5,8,11,14-tetraenoic acid), timnodonic acid ($C_{19}H_{29}COOH$, (5Z,8Z,11Z,14Z,17Z)-eicosa-5,8,11,14,17-pentaenoic acid) and cervonic acid ($C_{21}H_{31}COOH$, (4Z,7Z,10Z,13Z,16Z,19Z)-docosa-4,7,10,13,16,19-hexaenoic acid). Particular preference is given to lauric acid, palmitic acid and/or stearic acid.

It is particularly preferable when as diglycerol ester at least one ester of formula (I) is present (I)

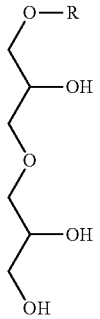

with R═$COC_nH_{2n+1}$ and/or R═COR', where n is an integer and R' is a branched alkyl radical or a branched or unbranched alkenyl radical and $C_nH_{2n+1}$ is an aliphatic, saturated linear alkyl radical.

Here, n is preferably an integer from 6-24 and examples of $C_nH_{2n+1}$ are therefore n-hexyl, n-heptyl, n-octyl, n-nonyl, n-decyl, n-dodecyl, n-tridecyl, n-tetradecyl, n-hexadecyl or n-octadecyl. More preferably n=8 to 18, particularly preferably is 10 to 16, very particularly preferably is 12 (diglycerol monolaurate isomer having a molecular weight of 348 g/mol, which is particularly preferred as the main product in a mixture). Preferably according to the invention, the aforementioned ester moieties are also present in the other isomers of diglycerol.

Accordingly, there may also be a mixture of various diglycerol esters.

Diglycerol esters used with preference have an HLB value of at least 6, particularly preferably 6 to 12, the HLB value being defined as the "hydrophilic-lipophilic balance" which is calculated as follows by the Griffin method:

$$HLB=20\times(1-M_{lipophilic}/M),$$

where $M_{lipophilic}$ is the molar mass of the lipophilic fraction of the diglycerol ester and M is the molar mass of the diglycerol ester.

Table 1 shows, by way of example and using various heat pipes made from different materials and having different external diameters and wall thicknesses, that the ratio of external diameter to wall thickness of the heat pipe is decisive for the heat pipe to withstand the loads occurring during the insert molding, without intending to restrict the invention to these examples. In each case, an injection pressure of about 1000 bar was applied during the injection molding, with a holding pressure of 600 bar.

TABLE 1

| Material | External diameter | Wall thickness | Survived injection molding process without damage? |
|---|---|---|---|
| Copper | 4 mm | 0.2 mm | no |
| Copper | 6 mm | 1 mm | yes |
| Copper | 8 mm | 1 mm | yes |
| Stainless steel | 1.5 mm | 0.25 mm | yes |
| Stainless steel | 3 mm | 0.25 mm | no |
| Stainless steel | 3 mm | 0.5 mm | yes |
| Copper | 4 mm | 0.5 mm | yes |
| Copper | 4 mm | 0.75 mm | yes |
| Copper | 4 mm | 1 mm | yes |
| Copper | 5 mm | 0.5 mm | yes |

A preferred configurations of the invention is illustrated by the following FIGURE, without the invention being restricted thereby to this configuration.

FIG. 1 here shows the heat dissipation system according to the invention for a heat source; the following designations being used:

1 heat source,
2 heat coupling-in element,
3 heat pipe
4 heatsink.

The invention claimed is:

1. A heat dissipation system for a heat source, wherein the heat dissipation system comprises
a heat pipe,
a heat coupling-in element, and
a heat coupling-out element,
wherein the ratio of external diameter to wall thickness of the heat pipe is from 10:1 to 4:1, and
wherein the heat coupling-out element comprises at least 50% by weight, of a thermally conductive thermoplastic composition having an in-plane thermal conductivity of 1 to 50 W/(m*K).

2. The heat dissipation system as claimed in claim 1, wherein the heat pipe has been insert molded with the thermally conductive thermoplastic composition of the heat coupling-out element.

3. The heat dissipation system as claimed in claim 1, wherein the thermally conductive thermoplastic composition is a composition containing a polycarbonate.

4. The heat dissipation system as claimed in claim 1, wherein the heat source is a lighting means.

5. The heat dissipation system as claimed in claim 1, wherein the heat dissipation system is a component of a luminaire.

6. The heat dissipation system as claimed claim 1, wherein the heat dissipation system is a component of the housing of a vehicle lamp.

7. The heat dissipation system as claimed in claim 1, wherein the heat coupling-out element is designed as a heatsink which is located inside or outside on the vehicle lamp lens.

8. A luminaire comprising the heat dissipation system as claimed in claim 1.

9. The luminaire as claimed in claim 8, wherein the luminaire is designed as a lamp.

* * * * *